US012516540B1

(12) United States Patent
Waldraff

(10) Patent No.: US 12,516,540 B1
(45) Date of Patent: Jan. 6, 2026

(54) SUMMER BREEZE FAN, AND A SUPPORT FOR CANOPY TENTS AND GAZEBOS

(71) Applicant: Dennis Waldraff, Franklin, KY (US)

(72) Inventor: Dennis Waldraff, Franklin, KY (US)

( * ) Notice: Subject to any disclaimer, the term of this patent is extended or adjusted under 35 U.S.C. 154(b) by 285 days.

(21) Appl. No.: 18/235,681

(22) Filed: Aug. 18, 2023

Related U.S. Application Data

(60) Provisional application No. 63/399,569, filed on Aug. 19, 2022.

(51) Int. Cl.
*E04H 15/14* (2006.01)
*F04D 29/64* (2006.01)

(52) U.S. Cl.
CPC ..... *E04H 15/14* (2013.01); *F04D 29/646* (2013.01)

(58) Field of Classification Search
CPC ..... E04H 15/14
See application file for complete search history.

(56) References Cited

U.S. PATENT DOCUMENTS 5,007,811 A 4/1991 Hopkins
5,567,117 A * 10/1996 Gunn ..... F04D 25/088 248/222.52
6,691,721 B2 2/2004 Apple
6,732,752 B2 5/2004 Cohen et al.
6,840,742 B2 1/2005 Cohen et al.
7,451,776 B2 * 11/2008 Chen ..... E04H 15/48 135/147
7,625,186 B1 * 12/2009 Lueddecke ..... F04D 29/646 416/243
7,703,466 B1 4/2010 Smith
7,836,905 B2 * 11/2010 Tarter ..... E04H 15/14 135/96
8,337,751 B2 * 12/2012 Stewart ..... A47K 3/286 52/79.5
9,151,514 B2 10/2015 Arnold, III
9,982,679 B2 * 5/2018 Santolucito ..... F04D 25/06
10,676,954 B1 6/2020 Oppenheim
11,129,454 B1 9/2021 Campbell et al.
11,761,230 B1 * 9/2023 Drummond ..... E04H 15/14 135/117
2008/0056898 A1 3/2008 Li
2011/0005560 A1 * 1/2011 Nair ..... F24S 25/10 135/117
2017/0138531 A1 * 5/2017 Arnold, III ..... F16M 11/10

* cited by examiner

*Primary Examiner* — Noah Chandler Hawk
(74) *Attorney, Agent, or Firm* — John Rizvi; John Rizvi, P.A.—The Patent Professor®

(57) ABSTRACT

A combined overhead fan device including a fan support for outdoor canopy tents and gazebos is disclosed. A central mount member and a canopy mount bracket may be provided on the central mount member. The canopy mount bracket may be configured for attachment to a canopy frame of the canopy. The central mount member may be configured to facilitate attachment of an overhead fan to the central mount member. At least one support member may extend from the central mount member. The support members may be configured to engage respective frame members of the canopy frame. Accordingly, the overhead fan may be operated to cool the area beneath the canopy to the comfort of individuals as they stand or sit beneath the canopy.

17 Claims, 13 Drawing Sheets

SUMMER BREEZE FAN, AND A SUPPORT FOR CANOPY TENTS AND GAZEBOS

CROSS-REFERENCE TO RELATED APPLICATIONS

This application claims the benefit of U.S. Provisional Patent Application Ser. No. 63/399,569 filed on Aug. 19, 2022, which is incorporated by reference herein in its entirety.

FIELD OF THE INVENTION

The present invention relates generally to outdoor canopies, and more particularly, to a fan support which can be deployed in outdoor canopy tents and gazebos to cool a covered area.

BACKGROUND OF THE INVENTION

Heat, insects, precipitation, and other outdoor elements often significantly reduce people's capacity to enjoy or endure outdoor activities. Therefore, erectable outdoor canopies are often utilized to shade and cool groups of people for a variety of outdoor events. These canopy structures enable individuals to congregate in an outdoor setting under conditions which would be uncomfortable, as well as to provide boundaries for groups of individuals selling items and the like, and separation of multiple groups from each other in a crowd. For instance, outdoor canopies have proven effective as temporary cover for outdoor sporting events, tailgating, and providing food and beverages to attendees at such events. Local fairs, craft shows, and the like may utilize canopy structures to provide separate areas for individuals and/or groups. Oftentimes, canopies are used to shade mourners at a graveside service prior to interment of the deceased.

Although canopies may be effective in shielding and protecting individuals from the sun, there remains the potential for stagnant air beneath the canopy. This, particularly when coupled with high humidity, may cause great discomfort to individuals who seek shade beneath the canopy. In some cases, the lack of circulating air beneath the canopy may increase the discomfort of those who take refuge beneath the canopy. Thus, there lies a significant need to ensure increased comfort for those using such canopies and/or tents, particularly in such high temperature/humidity locations or under such conditions.

Overhead ceiling fans and the like have been utilized for many years to provide air circulation in an enclosed space inhabited by individuals. Overhead fans are available in a variety of designs and are often used for aesthetic purposes. Overhead fans may be provided in many different types of structures including homes, office buildings, restaurants, and the like. Overhead fans are also often used to circulate air in outdoor locations, such as porches, particularly in hot weather climates.

A typical conventional outdoor canopy may include an elevated frame which is supported above the ground by multiple legs. A fabric canopy may be supported on the frame to cover or shade the area beneath the frame. However, the conventional canopy frame typically lacks a central support structure for an overhead fan. Moreover, in operation, oscillating fans may cause instability, especially when the fans are mounted to temporary canopy structures.

Accordingly, there is need for a solution to the above noted problems. For example, there is need of a fan support that can be deployed in outdoor canopy tents and gazebos to cool a covered area.

SUMMARY OF THE INVENTION

The present invention is directed to a fan support which can be deployed in an outdoor canopy tents and gazebos to cool a covered area. An illustrative embodiment of the fan support may include a central mount member. A canopy mount bracket may be provided on the central mount member. The canopy mount bracket may be configured for attachment to a canopy frame of the canopy. The central mount member may be configured to facilitate attachment of an overhead fan to the central mount member. At least one support member may extend from the central mount member. The support members may be configured to engage respective frame members of the canopy frame. Accordingly, in an exemplary application, the canopy may be erected on the ground or other support surface. The canopy mount bracket on the central mount member may be attached to the canopy frame. An overhead fan may be attached to the central mount member. Accordingly, the overhead fan may be operated to cool the area beneath the canopy to the comfort of individuals as they stand or sit beneath the canopy. The support members may engage respective frame members of the canopy frame and impart additional support to the canopy frame and prevent excessive movement of the overhead fan, the fan support and the canopy frame, particularly in applications in which the overhead fan is an oscillating fan.

In an illustrative implementation of the invention, a fan support which can be deployed in outdoor canopy tents and gazebos to cool a covered area may include a central mount member. A canopy mount bracket may be provided on the central mount member. The canopy mount bracket may be configured for attachment to a canopy frame of the canopy. The central mount member may be configured to facilitate attachment of an overhead fan to the central mount member. At least one support member may extend from the central mount member. The support members may be pivotally attached to the central mount member. The pivoting support members may facilitate deployment of the fan support on canopies having various sizes and configurations. Accordingly, in an exemplary application, the canopy may be erected on the ground or other support surface. The canopy mount bracket on the central mount member may be attached to the canopy frame. An overhead fan may be attached to the central mount member. Accordingly, the overhead fan may be operated to cool the area beneath the canopy to the comfort of individuals as they stand or sit beneath the canopy. The support members may engage respective frame members of the canopy frame and impart additional support to the canopy frame and prevent excessive movement of the overhead fan, the fan support and the canopy frame, particularly in applications in which the overhead fan is an oscillating fan.

In a second aspect, the central mount member may be elongated and vertical with a first mount member end and a second mount member end. The canopy mount bracket may be provided on the first mount member end of the central mount member. The overhead fan may be configured for attachment to the second mount member end of the central mount member.

In another aspect, the canopy mount bracket may be detachably attached to the first mount member end of the central mount member.

In another aspect, the canopy mount bracket may include a mount bracket hub and at least one mount bracket arm extending from the mount bracket hub. The mount bracket arms of the mount bracket hub may be configured for detachable attachment to the canopy frame of the canopy.

In another aspect, each mount bracket arm of the canopy mount bracket may include a horizontal arm segment extending outwardly from the mount bracket hub, a vertical arm segment extending from the horizontal arm segment and an extending arm segment extending horizontally from the vertical arm segment. The horizontal arm segment, the vertical arm segment and the extending arm segment of each mount bracket arm may form a hook which has a bracket arm space and is configured to engage a corresponding slot in the canopy frame of the canopy.

In another aspect, the extending arm segment of each mount bracket arm may curve or are in a clockwise direction from the vertical arm segment of the mount bracket arm toward the adjacent mount bracket arm.

In another aspect, each support member may have a proximal support member end attached to the central mount member and a distal support member end opposite the proximal support member end. The distal support member end may be configured for attachment to the canopy frame of the canopy.

In another aspect, a support member mount bracket may attach the proximal support member end of each support member to the central mount member.

In another aspect, the support member mount bracket may be adjustably mounted with respect to the central mount member.

In another aspect, the support member mount bracket may have a central through-bore sized and configured to receive the support member mount bracket.

In another aspect, a pivot pin may pivotally attach the proximal support member end of each support member to the corresponding support member mount bracket.

In another aspect, a frame attachment bracket may be provided on the distal support member end of each support member. The frame attachment bracket may be configured to engage the canopy frame of the canopy.

In another aspect, the frame attachment bracket may be pivotally attached to the distal support member end of each support member.

In another aspect, a pivot pin may pivotally attach the frame attachment bracket to the distal support member end of each support member.

In another aspect, the overhead fan may include a central fan motor housing. Multiple fan blades may extend from the fan motor housing. A fan mount member may extend from the fan motor housing. The fan mount member may be configured for attachment to the second mount member end of the central mount member.

In another aspect, a fan pole may be inserted into the fan motor housing of the overhead fan. The fan pole may extend downwardly from the fan motor housing to the ground or other support surface to support the overhead fan and the center of the canopy frame of the canopy.

In another aspect, the canopy frame of the canopy may include multiple outer frame members. Frame corners may be formed by and between the outer frame members. Canopy legs may extend downwardly from the canopy frame at the respective frame corners. Inner frame members may angle upwardly and inwardly from the outer frame members at the respective frame corners. A center frame member may be supported by the inner frame members. A canopy cover may be supported by the outer frame members, the inner frame members and the center frame member of the canopy frame. The canopy mount bracket on the central mount member may be configured for attachment to the center frame member.

In an aspect, the present disclosure relates to a fan support for canopy tents and gazebos, the fan support including a central mount member having a first mount member end and a second mount member end, the second mount member end configured for attachment to an overhead fan, a canopy mount bracket carried by the first mount member end of the central mount member, the canopy mount bracket configured for attachment to a canopy, a support member mount bracket carried by the central mount member, the support member mount bracket positionally adjustable along the central mount member, and at least one support member having a proximal support member end pivotally carried by the support member mount bracket and a distal support member end opposite the proximal support member end, the distal support member end configured for engagement with the canopy.

In some aspects, the canopy mount bracket may be detachably attached to the first mount member end of the central mount member.

In some aspects, the canopy mount bracket may include a mount bracket hub attached to the first mount member end of the central mount member, and at least one mount bracket arm extending from the mount bracket hub, the at least one mount bracket arm configured for detachable attachment to the canopy.

In some aspects, the at least one mount bracket arm may include a horizontal arm segment extending outwardly from the mount bracket hub, a vertical arm segment extending from the horizontal arm segment, and an extending arm segment extending horizontally from the vertical arm segment.

In some aspects, the horizontal arm segment, the vertical arm segment, and the extending arm segment of the at least one mount bracket arm may form a hook having a bracket arm space and configured for engaging with a corresponding slot in the canopy.

In some aspects, the extending arm segment may be configured to curve in a clockwise direction from the vertical arm segment of one mount bracket arm of the at least one mount bracket arm toward an adjacent mount bracket arm.

In some aspects, the support member mount bracket may be configured to attach the proximal support member end of the at least one support member to the central mount member.

In some aspects, the support member mount bracket may include a central through-bore configured to receive the central mount member.

In some aspects, the support member mount bracket may include a support member pivot pin configured to pivotally attach the proximal support member end of the at least one support member to the corresponding support member mount bracket.

In some aspects, the distal support member end may include a frame attachment bracket pivotally attached thereto and configured for engagement with the canopy. In an embodiment, a bracket pivot pin may be configured to pivotally attach the frame attachment bracket to the distal support member end.

In another aspect, the present disclosure relates to a combined overhead fan structure, including a canopy, a fan support, and an overhead fan. The canopy includes a canopy frame including inner frame members, outer frame members, and a center frame member, at least one canopy leg extending downwardly from the canopy frame, and a canopy cover supported by the inner frame members, the outer frame members, and the center frame member of the canopy frame. The overhead fan includes a fan motor housing, a plurality of fan blades extending from the fan motor housing, and a fan mount member extending from the fan motor housing and configured for attachment to the canopy via a fan support. The fan support includes a central mount member having a first mount member end and a second mount member end, the second mount member end configured for attachment to the overhead fan, wherein a canopy mount bracket carried by the first mount member end is configured for attachment to the center frame member of the canopy.

In some aspects, the fan support may include a threaded mount member stud protruding from the second mount member end of the central mount member. In an embodiment, the fan mount member may include a threaded opening configured to receive and engage the threaded mount member stud for attachment of the overhead fan to the central mount member of the fan support.

In some aspects, the combined overhead fan structure may include a fan pole extending downwardly from the fan motor housing of the overhead fan to a ground support.

In some aspects, the overhead fan may include a clamp extending from the fan motor housing, and a fan blade hub assembly rotatably supported on the clamp and including the plurality of fan blades.

In some aspects, the fan support may include a support member mount bracket carried by the central mount member, the support member mount bracket positionally adjustable along the central mount member, and at least one support member having a proximal support member end pivotally carried by the support member mount bracket and a distal support member end opposite the proximal support member end, the distal support member end configured for engagement with the canopy.

In another aspect, the present disclosure relates to a method for providing a fan support for a canopy, the method including assembling the fan support, the canopy, and an overhead fan, the fan support including a central mount member, a canopy mount bracket, a support member mount bracket, and at least one support member, the canopy including a canopy frame including inner frame members, outer frame members, and a center frame member, at least one canopy leg, and a canopy cover, and the overhead fan including a fan motor housing, a plurality of fan blades, and a fan mount member, and de-assembling the fan support, the canopy, and the overhead fan after use of the overhead fan. The assembling includes assembling the canopy on a ground support, attaching the canopy mount bracket of the fan support to the center frame member of the canopy frame, inserting at least one mount bracket arm of the canopy mount bracket into respective bracket arm slots in the center frame member, rotating the central mount member for engagement of the at least one mount bracket arm with the respective bracket arm slots, attaching the at least one support member to the corresponding inner frame members of the canopy frame, attaching the overhead fan to the central mount member, inserting a fan pole into the fan motor housing of the overhead fan, the fan pole extending downwardly onto the ground support, and operating the overhead fan to circulate air beneath the canopy cover of the canopy.

In some aspects, assembling the canopy may include arranging the at least one canopy leg vertically on the ground support, and attaching the at least one canopy leg to the canopy frame, including one of pivotally attaching the at least one canopy leg to the canopy frame between a folded configuration and an extended configuration of the canopy, or detachably attaching the at least one canopy leg to the canopy frame.

In some aspects, de-assembling the fan support, the canopy, and the overhead fan may include removing the fan pole from the fan motor housing of the overhead fan, detaching the overhead fan from the central mount member, and detaching the canopy mount bracket from the center frame member by rotating the central mount member in a counterclockwise direction to disengage the at least one mount bracket arm from the respective bracket arm slots.

In some aspects, the center frame member may support the central mount member in a downwardly extending configuration.

In some aspects, attaching the overhead fan to the central mount member may include engaging a threaded mount member stud of the central mount member with a threaded opening of the fan mount member.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
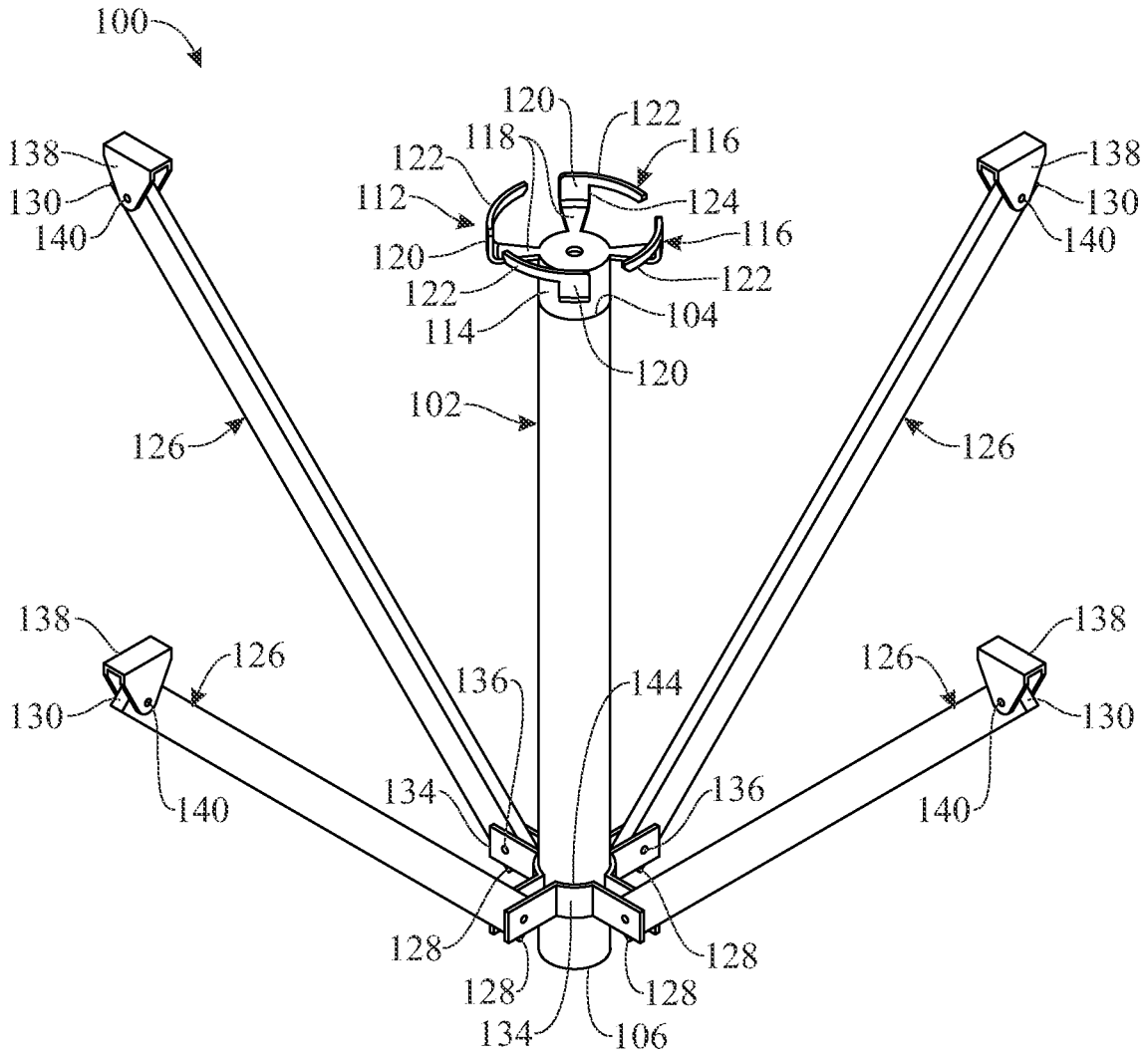
FIG. 1 presents a top perspective view of a fan support for canopy tents and gazebos, in accordance with an illustrative embodiment of the present invention.
Figure 2:
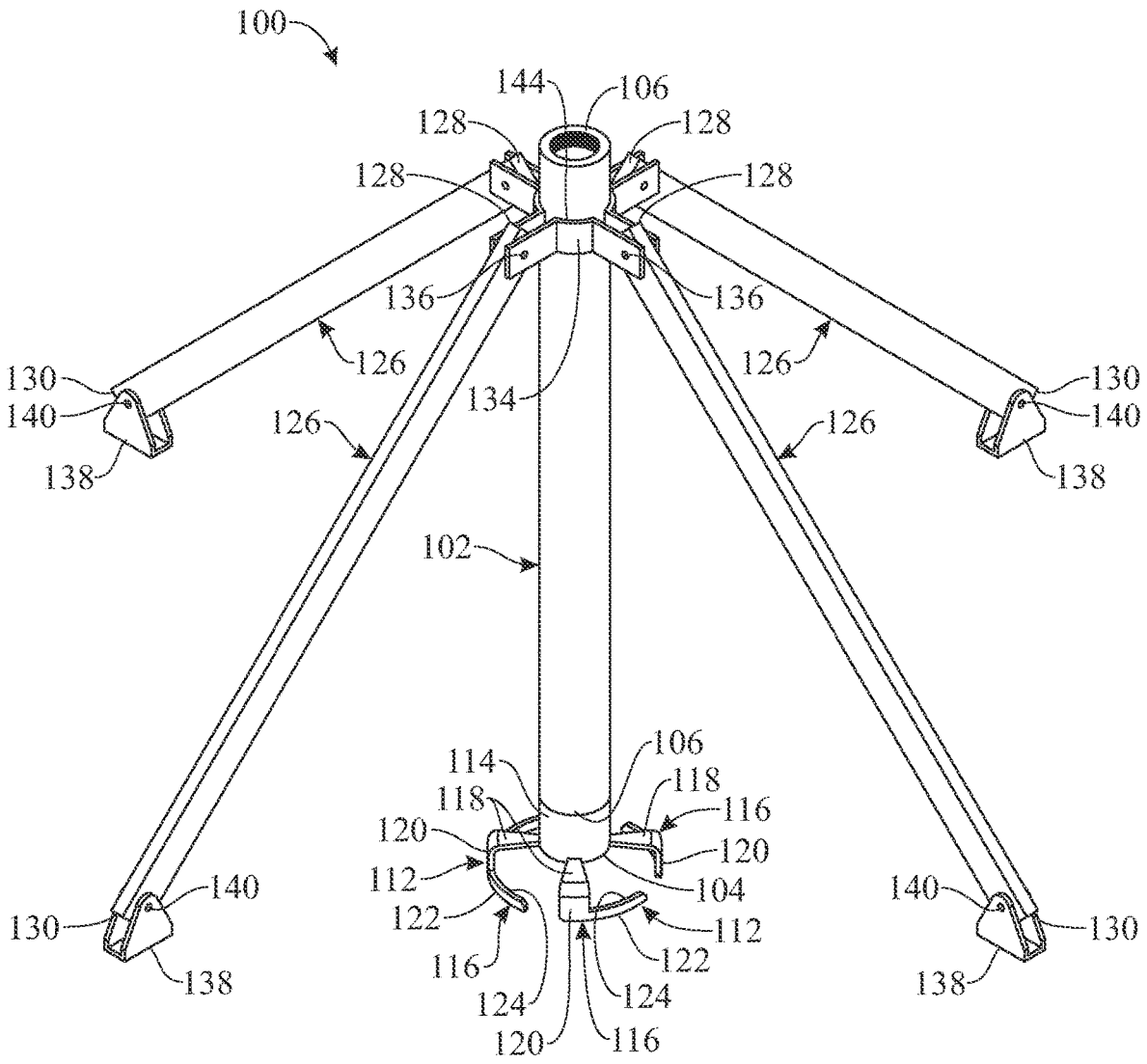
FIG. 2 presents a bottom perspective view of the fan support illustrated in FIG. 1.
Figure 3:
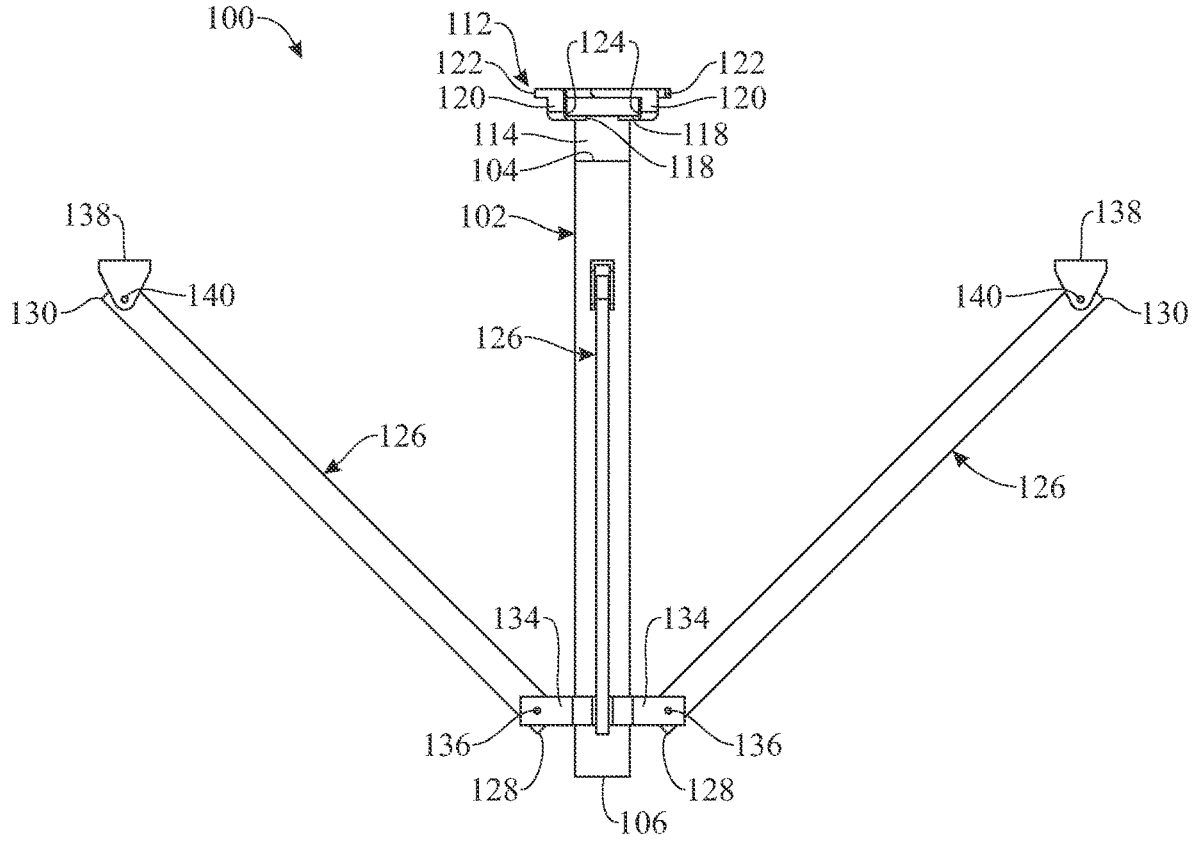
FIG. 3 presents a side view of the fan support illustrated in FIG. 1.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a fan support which can be deployed in outdoor canopy tents and gazebos to cool a covered area.

Referring initially to FIGS. 1-15, a fan support for a canopy 160, hereinafter fan support 100, is illustrated in accordance with an exemplary embodiment of the present invention. As used herein, "canopy" includes, but is not limited to, any type of structure which is used to provide a cover, shade, or shield from the sun, precipitation, and/or other elements in an outdoor setting. Examples of canopies 160 include, but are not limited to, tents, gazebos, and other tent-like structures. As shown for instance in FIG. 1, the fan support 100 may include a central mount member 102. A canopy mount bracket 112 may be provided on the central mount member 102. The canopy mount bracket 112 may be configured for attachment to a canopy frame 162 of the canopy 160 (FIG. 5). The central mount member 102 may be configured to facilitate attachment of an overhead fan 150 to the central mount member 102, typically as will be hereinafter described. At least one, and typically, multiple support members 126 may extend from the central mount member 102. The support members 126 may be configured to engage respective inner frame members 168 (FIG. 5) of the canopy frame 162. In some embodiments, each support member 126 may be made of wood, for example and without limitation.

As illustrated in FIG. 5, in an exemplary application including a combined overhead fan structure including the canopy 160, the fan support 100, and the overhead fan 150, the fan support 100 may be deployed in the outdoor canopy 160 to cool the area covered by the canopy 160. The canopy 160 may be erected on the ground or other support surface (not illustrated). The canopy mount bracket 112 on the central mount member 102 may be attached to the canopy frame 162. The overhead fan 150 may be attached to the central mount member 102. Accordingly, the overhead fan 150 may be operated to cool the area beneath the canopy 160 to the comfort of individuals as they stand or sit beneath the canopy 160. The support members 126 may engage respective inner frame members 168 of the canopy frame 162 and impart additional support to the canopy frame 162 and prevent excessive movement of the overhead fan 150, the fan support 100, and the canopy frame 162, particularly in applications in which the overhead fan 150 is an oscillating fan.

In some embodiments, the support members 126 may be pivotally attached to the central mount member 102. The pivoting support members 126 may facilitate deployment of the fan support 100 on canopies 160 having various sizes and configurations.

In some embodiments, the central mount member 102 may be elongated and vertical, with a first mount member end 104 and a second mount member end 106. The canopy mount bracket 112 may be provided on the first mount member end 104 of the central mount member 102. In some embodiments, the canopy mount bracket 112 may be detachably attached to the second mount member end 106 of the central mount member 102. The overhead fan 150 may be configured for attachment to the second mount member end 106 of the central mount member 102.

The canopy mount bracket 112 may include a mount bracket hub 114. In some embodiments, the mount bracket hub 114 may be made of plastic, for example and without limitation. The mount bracket hub 114 may be attached to the second mount member end 106 of the central mount member 102 according to the knowledge of those skilled in the art. For example, and without limitation, in some embodiments, the mount bracket hub 114 may be threadably attached to the second mount member end 106. In other embodiments, the mount bracket hub 114 may be attached to the second mount member end 106 using threaded fasteners, brackets, welding, and/or other suitable attachment techniques. In some embodiments, the mount bracket hub 114 may be fabricated in one piece with the second mount member end 106 according to the knowledge of those skilled in the art.

Multiple mount bracket arms 116 may extend from the mount bracket hub 114 of the canopy mount bracket 112. The mount bracket arms 116 may be configured for detachable attachment to the canopy frame 162 of the canopy 160.

In some embodiments, each mount bracket arm 116 of the canopy mount bracket 112 may include a horizontal arm segment 118 which extends outwardly from the mount bracket hub 114. A vertical arm segment 120 may extend from the horizontal arm segment 118. An extending arm segment 122 may extend horizontally from the vertical arm segment 120. The extending arm segment 122 may curve or arc in a clockwise direction from the vertical arm segment 120 toward the adjacent mount bracket arm 116. Accordingly, the horizontal arm segment 118, the vertical arm segment 120, and the extending arm segment 122 of each mount bracket arm 116 may form a hook which has a bracket arm space 124 and is configured to engage a corresponding slot in the canopy frame 162 of the canopy 160.

In another aspect, each support member 126 may have a proximal support member end 128 attached to the central mount member 102 and a distal support member end 130 opposite the proximal support member end 128. The distal support member end 130 of each support member 126 may be configured for attachment to the canopy frame 162 of the canopy 160 typically as will be hereinafter described.

In some embodiments, a support member mount bracket 134 may attach the proximal support member end 128 of each support member 126 to the central mount member 102. A support member pivot pin 136 may pivotally attach the proximal support member end 128 of each support member 126 to the corresponding support member mount bracket 134. Each support member pivot pin 136 may extend through a corresponding pair of aligned or registering pivot fastener openings 190 (FIGS. 14 and 15) in each corresponding spaced-apart pair of support member mount brackets 134.

The support member mount bracket 134 may be adjustably mounted with respect to the central mount member 102. In some embodiments, the support member mount bracket 134 may have a central through-bore 144 which is sized and configured to receive the central mount member 102. Accordingly, the support member mount bracket 134 may slide with respect to the central mount member 102 to selectively adjust the outward extension and reach of the support members 126 with respect to the central mount member 102.

Figure 14:
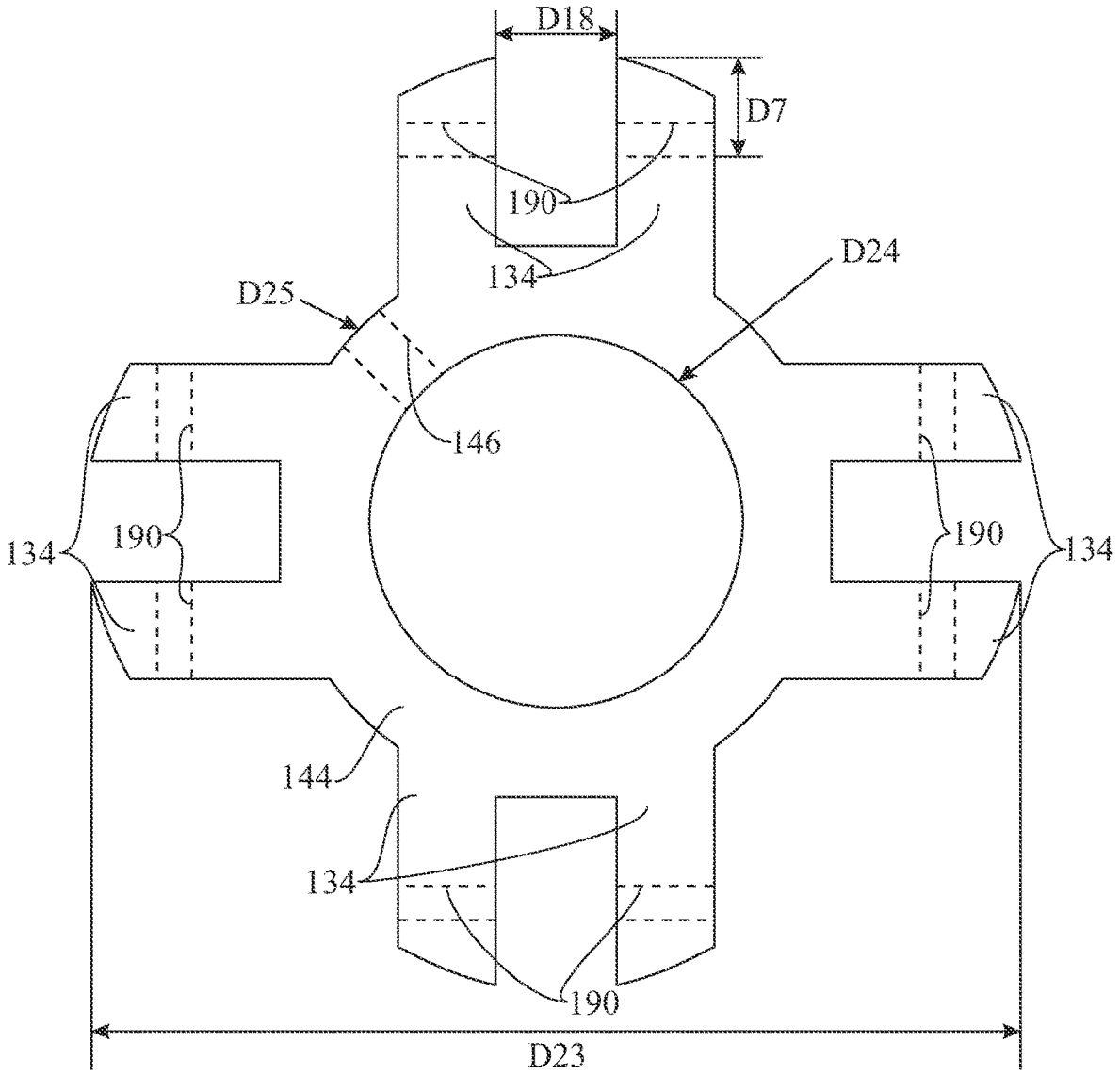
FIG. 14 presents a top view of typical support member mount brackets suitable for mounting the support members to the central mount member according to an illustrative embodiment of the fan support.

As illustrated in FIG. 14, at least one through hole 146 may extend transversely through the structure of the through bore 144. A bracket fastener (not illustrated) may be threaded in the through hole 146 and tightened against the central mount member 102 to secure the support member mount brackets 134 at a selected height on the central mount member 102.

A frame attachment bracket 138 may be provided on the distal support member end 130 of each support member 126. The frame attachment bracket 138 may be configured to engage the canopy frame 162 of the canopy 160. The frame attachment bracket 138 may be configured for attachment to the canopy frame 162 using mechanical fasteners, brackets, and/or other suitable attachment technique known by those skilled in the art.

In some embodiments, the frame attachment bracket 138 may be pivotally attached to the distal support member end 130 of each support member 126. Accordingly, a bracket pivot pin 140 may pivotally attach the frame attachment bracket 138 to the distal support member end 130 of each support member 126.

Figure 9:
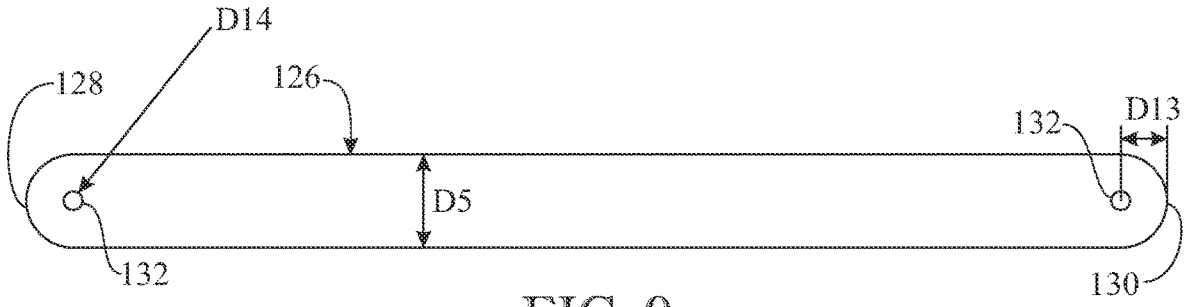
FIG. 9 presents a top view of a typical support member according to an illustrative embodiment of the fan support.
Figure 10:
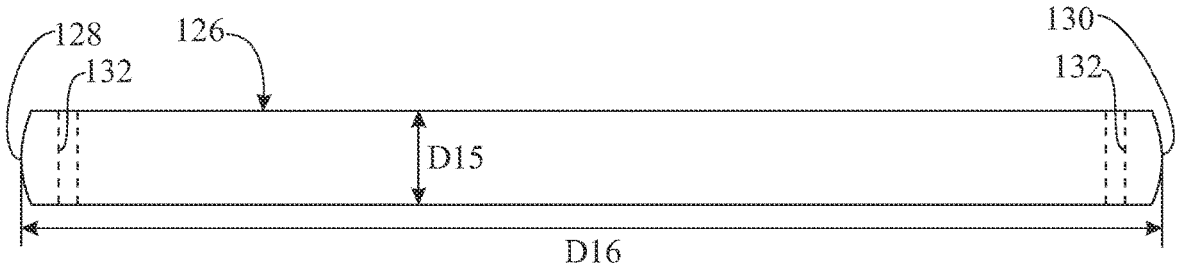
FIG. 10 presents a side view of the support member illustrated in FIG. 9.

As illustrated in FIGS. 9 and 10, in some embodiments, a fastener opening 132 may extend through each support member 126 adjacent to each corresponding one of the proximal support member end 128 and the distal support member end 130. The support member pivot pin 136 which pivotally attaches each support member 126 to the support member mount brackets 134 may extend through the fastener opening 132 adjacent to the proximal support member end 128. A bracket pivot pin (not numbered) which pivotally attaches each frame attachment bracket 138 to the corresponding support member 126 may extend through the fastener opening 132 adjacent to the distal support member end 130. The bracket pivot pin may extend through a pivot pin opening 142 (FIGS. 11-13) in each corresponding frame attachment bracket 138.

Figure 4:
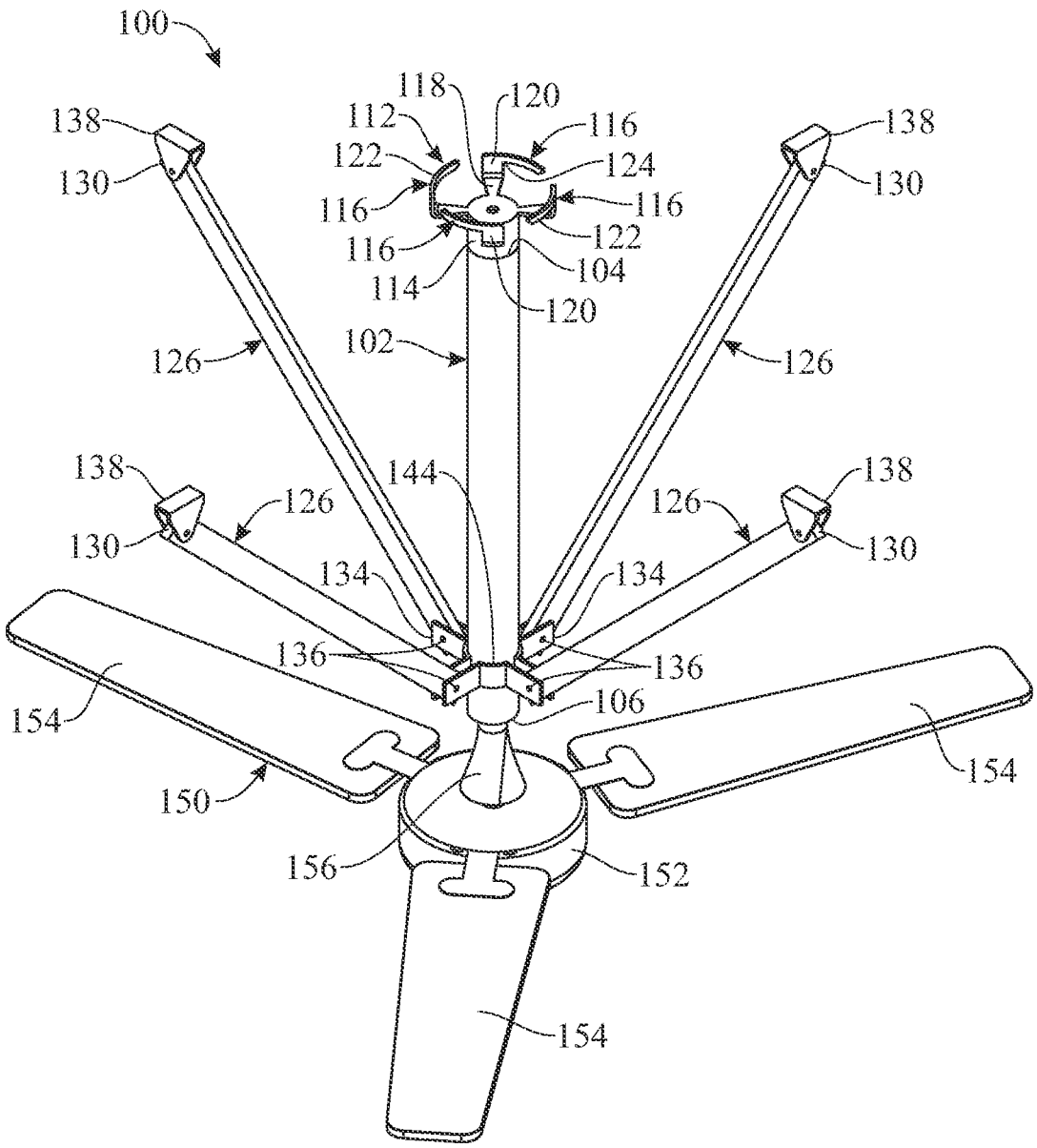
FIG. 4 presents a top perspective view of the fan support, with an overhead fan attached to a central mount member of the fan support in typical application thereof.
Figure 5:
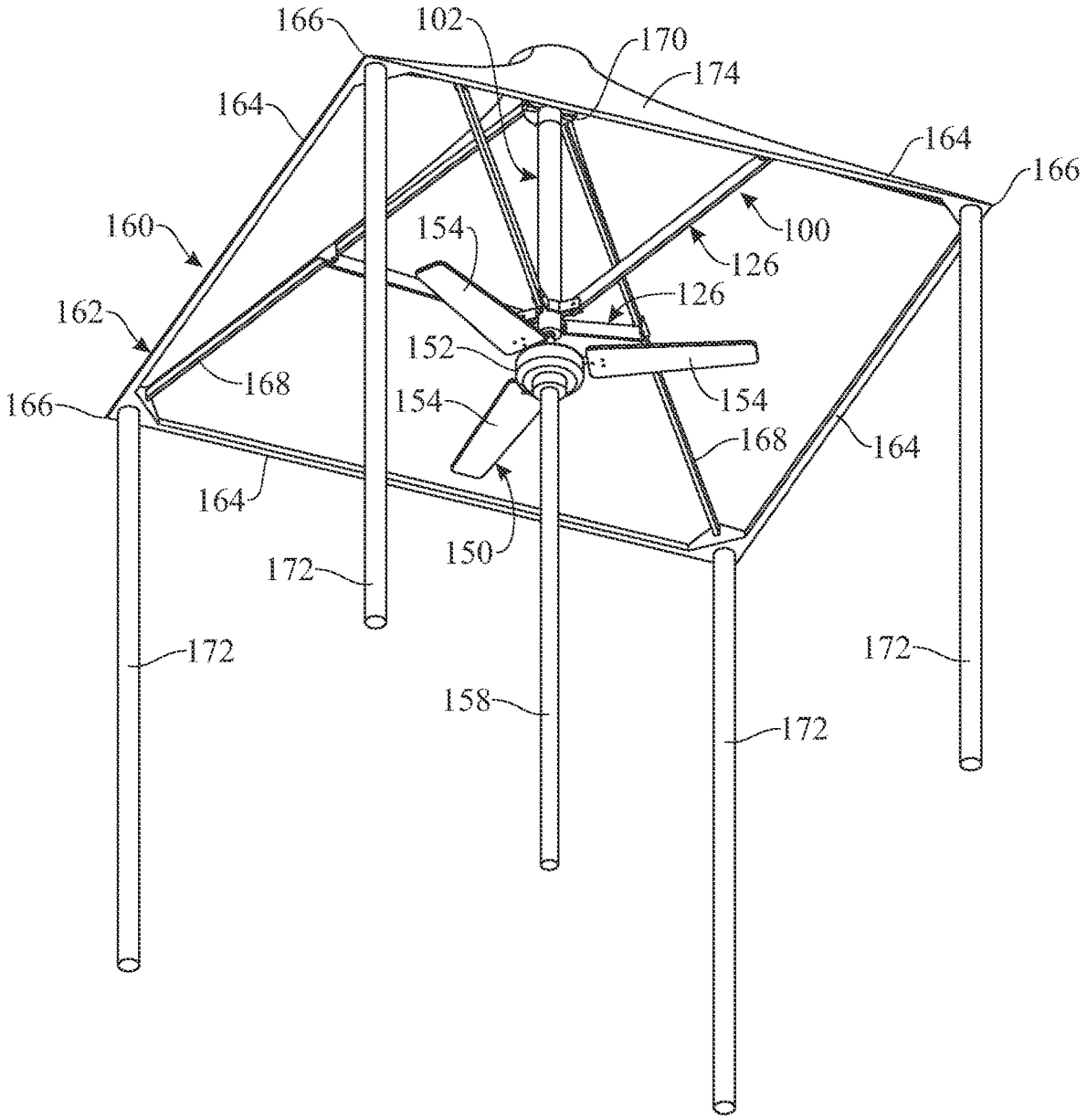
FIG. 5 presents a bottom perspective view of a canopy with the fan support attached to the central mount member of the fan support.

As illustrated in FIG. 4, the overhead fan 150 may have a standard or conventional design. In some example embodiments, the overhead fan 150 may include a fan device as disclosed in U.S. Pat. No. 6,325,084. For example, the overhead fan 150 may include at least one of a fan motor housing, a clamp on the fan motor housing, a drive collar attached to and disposed beneath the fan blade hub assembly, and a fan blade hub assembly having fan blades extending therefrom. The fan blade hub assembly includes a plurality of fan blade shafts extending therefrom, each fan blade secured below each fan blade shaft. The overhead fan may also include a driver collar attached to and disposed beneath the fan blade hub assembly, a bushing between the clamp and the drive collar rotatably supporting the drive collar on the clamp, and a drive wheel extending from the fan motor housing and engaging the drive collar for rotating the drive collar. Referring to FIG. 4, the overhead fan 150 may include a central fan motor housing 152 which houses an electric fan motor (not illustrated). Multiple fan blades 154 may extend from the fan motor housing 152. A fan mount member 156 may extend from the fan motor housing 152. The fan mount member 156 may be configured for attachment to the second mount member end 106 of the central mount member 102. The fan mount member 156 may be attached to the central mount member 102 via threading, mechanical fasteners, brackets, and/or other suitable attachment technique known by those skilled in the art.

Figure 8:
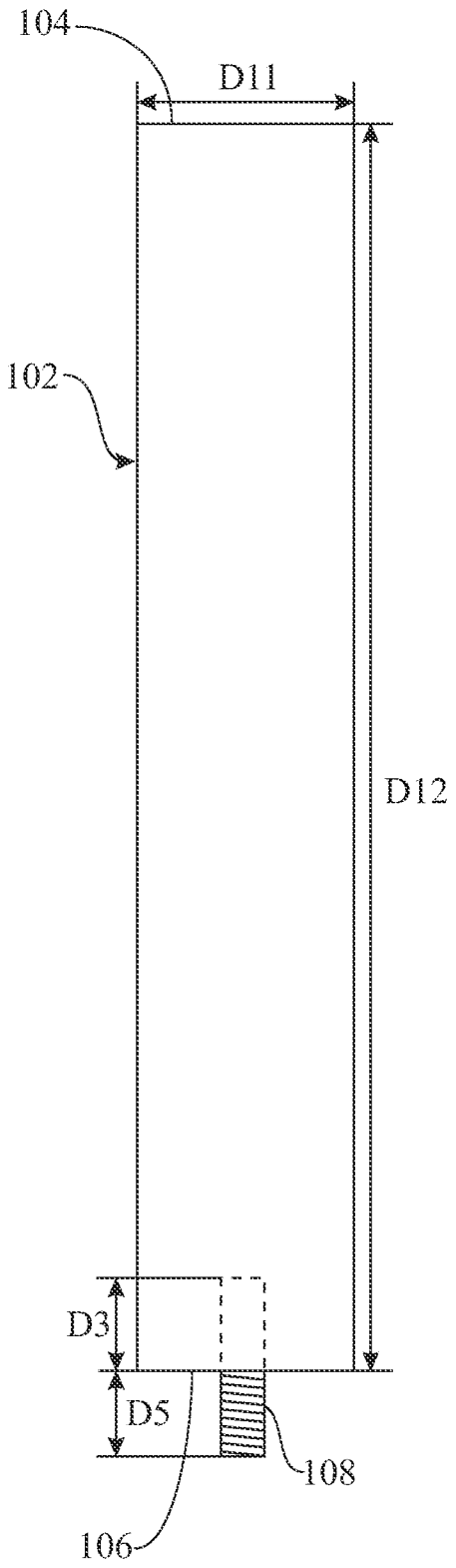
FIG. 8 presents a side view of a typical central mount member according to an illustrative embodiment of the fan support.

As illustrated in FIG. 8, in some embodiments, a threaded mount member stud 108 may protrude from the second mount member end 106 of the central mount member 102. The fan mount member 156 on the overhead fan 150 may have an interiorly-threaded opening (not illustrated) which receives and engages the mount member stud 108 to attach the overhead fan 150 to the central mount member 102.

As illustrated in FIG. 5, in some embodiments, a fan pole 158 may be inserted into the fan motor housing 152 of the overhead fan 150. The fan pole 158 may extend downwardly from the fan motor housing 152 to the ground or other support surface (not illustrated) on which the canopy 160 is supported to support the overhead fan 150 and the center of the canopy frame 162 of the canopy 160.

As illustrated in FIG. 5, in some applications of the fan support 100, the canopy frame 162 of the canopy 160 may include multiple outer frame members 164. Frame corners 166 may be formed by and between the outer frame members 164. Canopy legs 172 may extend downwardly from the canopy frame 162 at the respective frame corners 166. Inner frame members 168 may angle upwardly and inwardly from the outer frame members 164 at the respective frame corners 166. A center frame member 170 may be supported by the inner frame members 168. A canopy cover 174 may be supported by the outer frame members 164, the inner frame members 168, and the center frame member 170 of the canopy frame 162. The canopy mount bracket 112 on the central mount member 102 may be configured for attachment to the center frame member 170 typically as will be hereinafter described.

In a typical method of attachment of the fan support 100 to the canopy frame 162 of the canopy 160, the typically hook-shaped mount bracket arms 116 of the canopy mount bracket 112 may be configured to initially insert into respective companion bracket arm slots (not illustrated) in the center frame member 170 of the canopy frame 162. The mount bracket arms 116 may be configured to then engage the respective bracket arm slots by rotation of the central mount member 102 typically in the clockwise direction such that a portion of the center frame member 170 inserts into the bracket arm space 124 of each mount bracket arm 116. Conversely, the canopy mount bracket 112 may subsequently be detached from the center frame member 170 typically by counterclockwise rotation of the central mount member 102 such that the mount bracket arms 116 disengage from the respective bracket arm slots.

Figure 6:
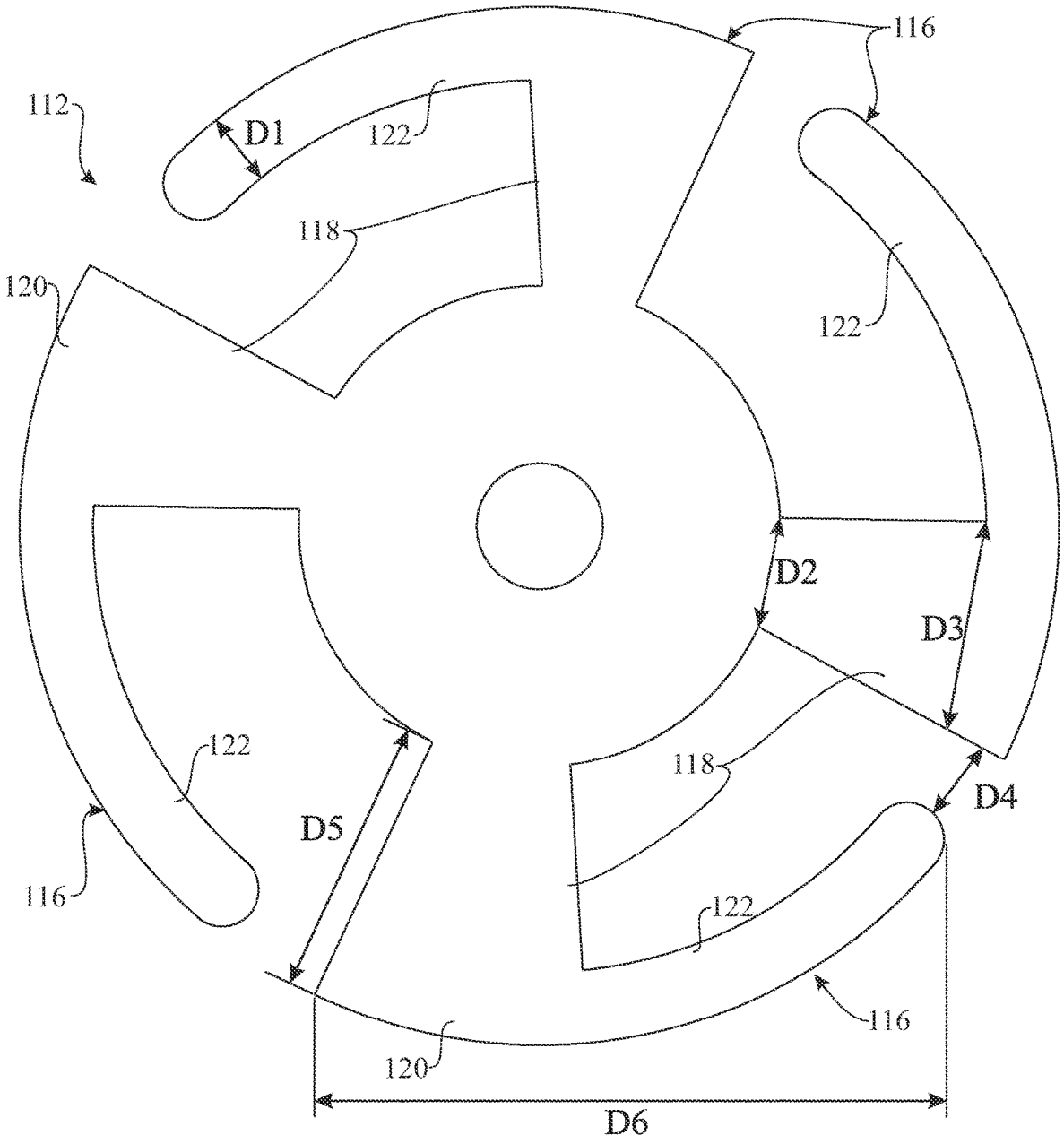
FIG. 6 presents a top view of a typical canopy mount bracket, in accordance with an illustrative embodiment of the fan support, with exemplary dimensions of the components of the canopy mount bracket.

Exemplary but non-limiting dimensions for the various components of the fan support 100 are illustrated in FIGS. 6-15. As illustrated in FIG. 6, in some embodiments, each mount bracket arm 116 may have a length D6 of 2.375". The horizontal arm segment 118 of each mount bracket arm 116 may have a length D5 of 1.000". The wide end of each horizontal arm segment 118 may have a width D3 of 0.750". The narrow end of each horizontal arm segment 118 may have a width D2 of 0.250". The extending arm segment 12 of each mount bracket arm 116 may have a width or thickness D1 of 0.25". The gap D4 between the adjacent mount bracket arms 116 may be 9/16".

Figure 7:
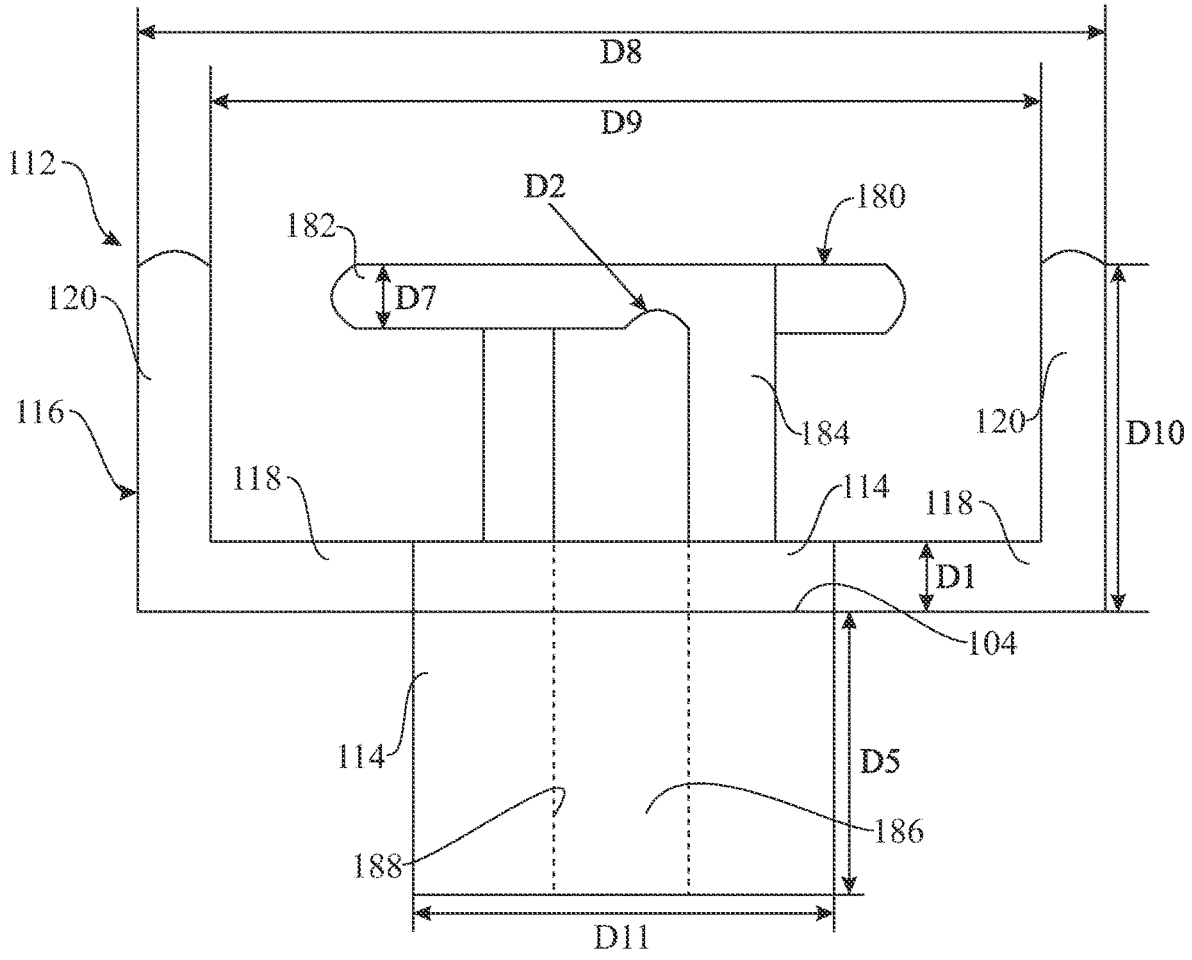
FIG. 7 presents a side view of the canopy mount bracket, more particularly illustrating a typical insert technique for attaching the canopy mount bracket to the central mount member of the fan support.

As illustrated in FIG. 7, in some embodiments, the canopy mount bracket 112 may be attached to the first mount member end 104 of the central mount member 102 using a mount bracket insert 180. The mount bracket insert 180 may include an insert head 182. An insert shaft 184 may extend from the insert head 182. An insert shank 186 may extend from the insert shaft 184. The insert shank 186 may extend into an insert shank opening 188 which extends into the first mount member end 104 of the central mount member 102. In some embodiments, the insert shank 186 may threadably engage the insert shank opening 188.

As further illustrated in FIG. 7, the horizontal arm segment 118 of each mount bracket arm 116 may have a length D9 of 0.250". The vertical arm segment 120 of each mount bracket arm 116 may have a height D10 of 1.25". The mount bracket hub 114 may have a length D5 of 1.000" and a width D11 of 1.500". The insert shank opening 188 may have a width or diameter D2 of 3/8". The insert head 182 of the mount bracket insert 180 may have a thickness D7 of 0.375".

As illustrated in FIG. 8, in some embodiments, the central mount member 102 may have a length D12 of 32" and a width D11 of 1.500". The mount member stud 108 may protrude into the second mount member end 106 at a depth D3 of 0.750" and may protrude beyond the second mount member end 106 at a length D5 of 3/8".

As illustrated in FIGS. 9 and 10, in some embodiments, each support member 126 may have a length D16 of 30", a width D5 of 1.000", and a thickness D15 of 0.500". Each fastener opening 132 may have a width D14 of 0.201". The fastener opening 132 may be spaced-apart from the corresponding proximal support member end 128 by a distance D14 of 0.250", and the fastener opening 132 may be spaced-apart from the distal support member end 130 by a distance D13 of about 5/16".

Figure 11:
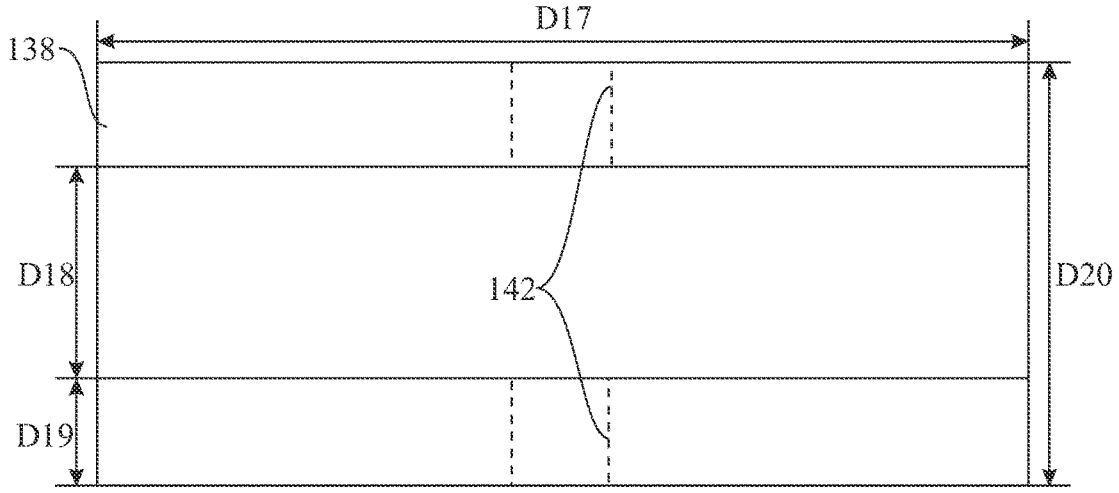
FIG. 11 presents a proximal end view of a typical frame attachment bracket according to an illustrative embodiment of the fan support.
Figure 12:
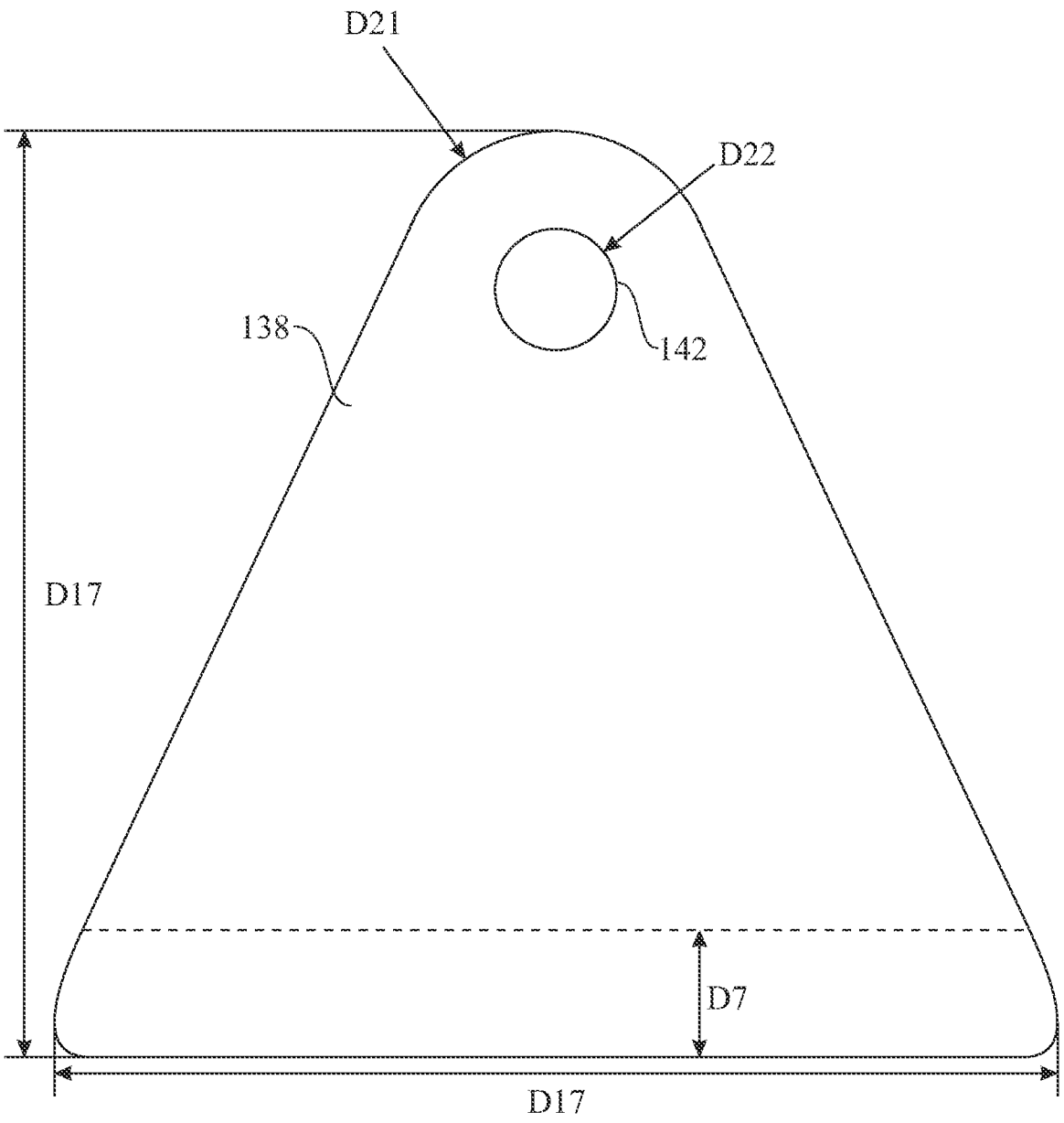
FIG. 12 presents a top view of the frame attachment bracket illustrated in FIG. 11.
Figure 13:
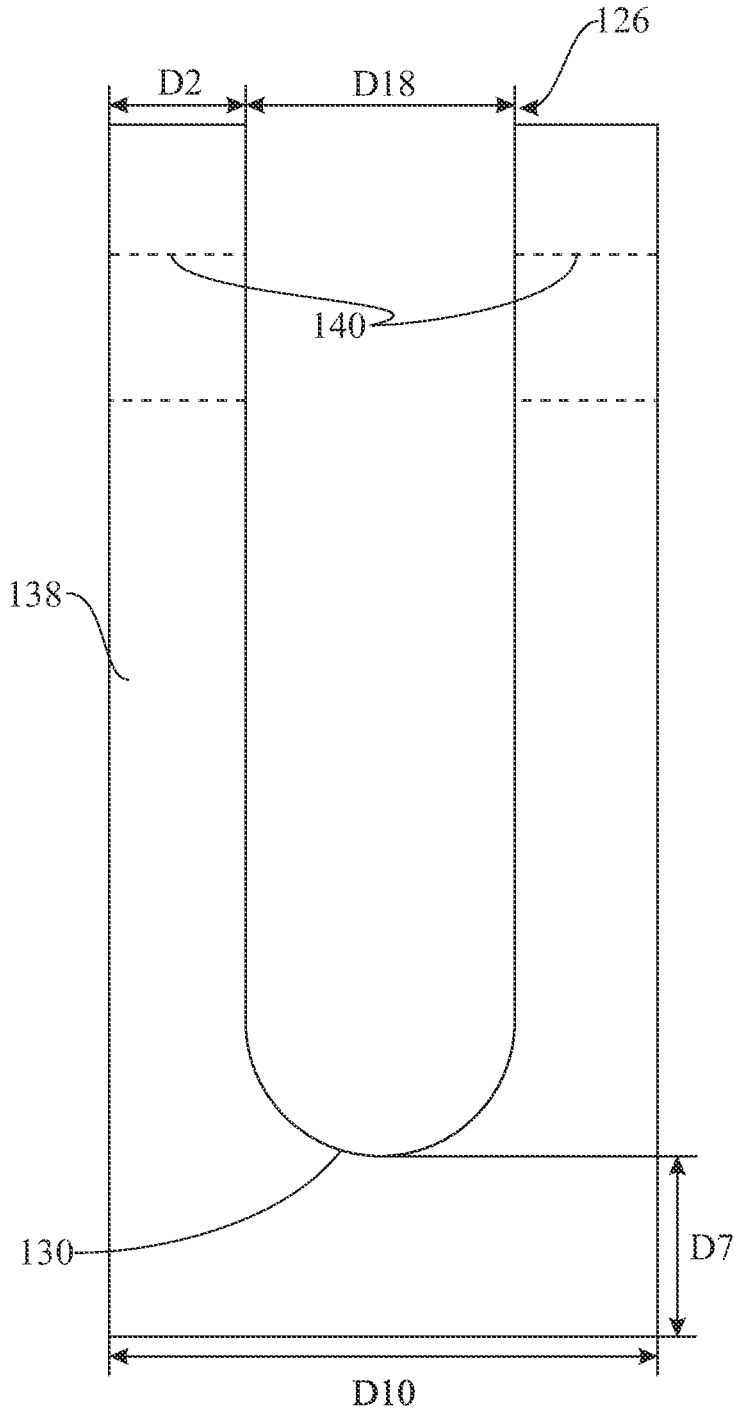
FIG. 13 presents a side view of the frame attachment bracket.

As illustrated in FIGS. 11-13, in some embodiments, each frame attachment bracket 138 may have a length and a width D17 of 2.250" and a total thickness D20 of 1.125". Each flange of each frame attachment bracket 138 may have a thickness D19 of 0.375". The pivot pin opening 142 for each bracket pivot pin 140 may have a width D22 of 0.250". The spacing D18 (FIG. 11) between the adjacent flanges may be 0.500". The connecting portion of each frame attachment bracket 138 may have a thickness D7 of 0.375". Each frame attachment bracket 138 may have a width D10 of 1.125". As illustrated in FIG. 13, each flange of the frame attachment bracket 138 may have a width D2 of 0.250".

Figure 15:
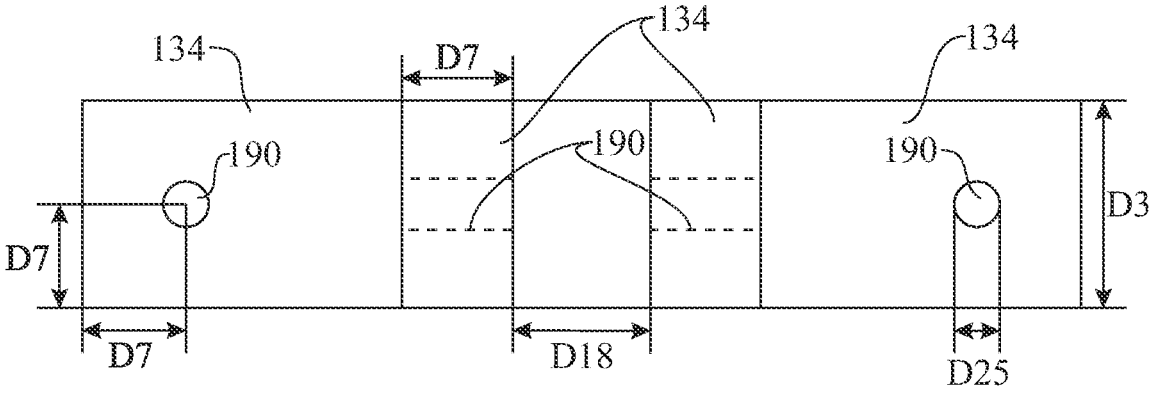
FIG. 15 presents a side view of the support member mount brackets illustrated in FIG. 14.

As illustrated in FIGS. 14 and 15, in some embodiments, the support member mount brackets 134 may have a total width D23 of 3.750". Each pair of support member mount brackets 134 may be spaced-apart from each other at a distance D18 of 0.500". The through-bore 144 may have a width or diameter D24 of 1.500". As illustrated in FIG. 14, at least one through hole 146 may extend through the through-bore 144 to accept a fastener (not illustrated). The fastener may be threaded in the through hole 146 and tightened against the central mount member 102 to secure the support member mount brackets 134 at the selected height on the central mount member 102. As illustrated in FIG. 15, each pivot fastener opening 190 may be disposed at a distance D7 of 0.375" from the distal or extending end of each corresponding support member mount bracket 134. Each pivot fastener opening 190 may also be centered in each corresponding support member mount bracket 134 at the distance D7 of 0.375" from the upper and lower edges of the support member mount bracket 134. As illustrated in FIG. 15, each pivot fastener opening 190 may have a diameter D25 of 0.250". Each support member mount bracket 134 may have a thickness D3 of 0.750". Each support member mount bracket 134 may have a thickness D7 of 0.375".

In a typical application of attachment of the fan support 100, the canopy 160 may be assembled and erected on the ground or other support surface (not illustrated) typically in an outdoor area. Accordingly, the canopy legs 172 may be deployed vertically on the ground or surface and the canopy frame 162 may be placed on the canopy legs 172. In some applications, the canopy legs 172 may be pivotally attached to the canopy frame 162 for deployment between a folded configuration and an extended configuration for deployment of the canopy 160. In other applications, the canopy frame 162 may be detachably attached to the canopy legs 172 according to the knowledge of those skilled in the art. The canopy cover 174 may be deployed in place over and attached to the outer frame members 164, the inner frame members 168, and the center frame member 170 of the canopy frame 162.

The canopy mount bracket 112 may be attached to the center frame member 170 of the canopy frame 162. Accordingly, the mount bracket arms 116 of the canopy mount bracket 112 may initially be inserted into respective bracket arm slots (not illustrated) in the center frame member 170. The central mount member 102 may then be rotated typically in the clockwise direction to facilitate engagement of the mount bracket arms 116 with the slots such that the center frame member 170 supports the central mount member 102 in a downwardly extending configuration.

The support members 126 of the fan support 100 may be pivoted with respect to the central mount member 102 typically via the respective support member mount brackets 134. The support member mount bracket 134 may be positionally adjusted along the central mount member 102 to extend or vary the reach of the support members 126 with respect to the central mount member 102. The frame attachment brackets 138 may be pivoted at the distal support member ends 130 of the respective support members 126 typically via the respective pivot pins 140. The frame attachment brackets 138 may be attached to the respective inner frame members 168 on the canopy frame 162 of the canopy 160 typically as was heretofore described.

The overhead fan 150 may be attached to the central mount member 102 typically by attachment of the fan mount member 156 (FIG. 4) to the second mount member end 106 of the central mount member 102. The fan pole 158 may be inserted into the fan motor housing 152 and may extend downwardly onto the ground or other support surface (not illustrated) for additional support of the overhead fan 150 beneath the canopy 160 as well as the center of the canopy frame 162. The overhead fan 150 may then be operated to circulate air beneath the canopy cover 174 of the canopy 160 and cool individuals (not illustrated) as the individuals stand or sit beneath the canopy 160.

After use of the canopy 160, the fan pole 158 may be removed from the fan motor housing 152 of the overhead fan 150. The overhead fan 150 may be detached from the central mount member 102, and the canopy mount bracket 112 on the central mount member 102 may be detached from the center frame member 170 of the canopy frame 162. The canopy 160 may be disassembled and/or folded for transport and storage.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A fan support for canopy tents and gazebos, the fan support comprising:

a central mount member having a first mount member end and a second mount member end, the second mount member end configured for attachment to an overhead fan;

a canopy mount bracket carried by the first mount member end of the central mount member, the canopy mount bracket configured for attachment to a canopy;

a support member mount bracket carried by the central mount member, the support member mount bracket positionally adjustable along the central mount member; and at least one support member having a proximal support member end pivotally carried by the support member mount bracket and a distal support member end opposite the proximal support member end, the distal support member end configured for engagement with the canopy, wherein the canopy mount bracket comprises:

a mount bracket hub attached to the first mount member end of the central mount member; and at least one mount bracket arm extending from the mount bracket hub, the at least one mount bracket arm configured for detachable attachment to the canopy, and wherein the at least one mount bracket arm comprises:

a horizontal arm segment extending outwardly from the mount bracket hub, a vertical arm segment extending from the horizontal arm segment; and an extending arm segment extending horizontally from the vertical arm segment.

2. The fan support of claim 1, wherein the canopy mount bracket is detachably attached to the first mount member end of the central mount member.

3. The fan support of claim 1, wherein the horizontal arm segment, the vertical arm segment, and the extending arm segment of the at least one mount bracket arm form a hook having a bracket arm space and configured for engaging with a corresponding slot in the canopy.

4. The fan support of claim 1, wherein the extending arm segment is configured to curve in a clockwise direction from the vertical arm segment of one mount bracket arm of the at least one mount bracket arm toward an adjacent mount bracket arm.

5. The fan support of claim 1, wherein the support member mount bracket is configured to attach the proximal support member end of the at least one support member to the central mount member.

6. The fan support of claim 1, wherein the support member mount bracket comprises a central through-bore configured to receive the central mount member.

7. The fan support of claim 1, wherein the support member mount bracket comprises a support member pivot pin configured to pivotally attach the proximal support member end of the at least one support member to the corresponding support member mount bracket.

8. The fan support of claim 1, wherein the distal support member end comprises a frame attachment bracket pivotally attached thereto and configured for engagement with the canopy, and wherein a bracket pivot pin is configured to pivotally attach the frame attachment bracket to the distal support member end.

9. A combined overhead fan structure, comprising:

a canopy, comprising:

a canopy frame comprising inner frame members, outer frame members, and a center frame member;

at least one canopy leg extending downwardly from the canopy frame; and a canopy cover supported by the inner frame members, the outer frame members, and the center frame member of the canopy frame;

an overhead fan, comprising:

a fan motor housing;

a plurality of fan blades extending from the fan motor housing; and a fan mount member extending from the fan motor housing and configured for attachment to the canopy via a fan support; and the fan support, comprising:

a central mount member having a first mount member end and a second mount member end, the second mount member end configured for attachment to the overhead fan, and wherein a canopy mount bracket carried by the first mount member end is configured for attachment to the center frame member of the canopy, and a threaded mount member stud protruding from the second mount member end of the central mount member, and wherein the fan mount member comprises a threaded opening configured to receive and engage the threaded mount member stud for attachment of the overhead fan to the central mount member of the fan support.

10. The combined overhead fan structure of claim 9, further comprising a fan pole extending downwardly from the fan motor housing of the overhead fan to a ground support.

11. The combined overhead fan structure of claim 9, wherein the overhead fan further comprises:

a clamp extending from the fan motor housing; and a fan blade hub assembly rotatably supported on the clamp and including the plurality of fan blades.

12. The combined overhead fan structure of claim 9, wherein the fan support further comprises:

a support member mount bracket carried by the central mount member, the support member mount bracket positionally adjustable along the central mount member; and at least one support member having a proximal support member end pivotally carried by the support member mount bracket and a distal support member end opposite the proximal support member end, the distal support member end configured for engagement with the canopy.

13. A method for providing a fan support for a canopy, the method comprising:

assembling the fan support, the canopy, and an overhead fan, the fan support comprising a central mount member, a canopy mount bracket, a support member mount bracket, and at least one support member, the canopy comprising a canopy frame including inner frame members, outer frame members, and a center frame member, at least one canopy leg, and a canopy cover, and the overhead fan comprising a fan motor housing, a plurality of fan blades, and a fan mount member; and de-assembling the fan support, the canopy, and the overhead fan after use of the overhead fan, wherein the assembling comprises:

assembling the canopy on a ground support;

attaching the canopy mount bracket of the fan support to the center frame member of the canopy frame;

inserting at least one mount bracket arm of the canopy mount bracket into respective bracket arm slots in the center frame member;

rotating the central mount member for engagement of the at least one mount bracket arm with the respective bracket arm slots;

attaching the at least one support member to the corresponding inner frame members of the canopy frame;

attaching the overhead fan to the central mount member;

inserting a fan pole into the fan motor housing of the overhead fan, the fan pole extending downwardly onto the ground support; and operating the overhead fan to circulate air beneath the canopy cover of the canopy.

14. The method of claim 13, wherein assembling the canopy comprises:

arranging the at least one canopy leg vertically on the ground support; and attaching the at least one canopy leg to the canopy frame, comprising one of pivotally attaching the at least one canopy leg to the canopy frame between a folded configuration and an extended configuration of the canopy; or detachably attaching the at least one canopy leg to the canopy frame.

15. The method of claim 13, wherein de-assembling the fan support, the canopy, and the overhead fan comprises:

removing the fan pole from the fan motor housing of the overhead fan;

detaching the overhead fan from the central mount member; and detaching the canopy mount bracket from the center frame member by rotating the central mount member in a counterclockwise direction to disengage the at least one mount bracket arm from the respective bracket arm slots.

16. The method of claim 13, wherein the center frame member supports the central mount member in a downwardly extending configuration.

17. The method of claim 13, wherein attaching the overhead fan to the central mount member comprises engaging a threaded mount member stud of the central mount member with a threaded opening of the fan mount member.

* * * * *